US006178801B1

(12) United States Patent
Ishida

(10) Patent No.: US 6,178,801 B1
(45) Date of Patent: Jan. 30, 2001

(54) FORGING DEVICE FOR CROWN-SHAPED HELICAL GEAR

(75) Inventor: Hitoshi Ishida, Shizuoka-ken (JP)

(73) Assignee: Ohashi Technica, Inc., Tokyo (JP)

( * ) Notice: Under 35 U.S.C. 154(b), the term of this patent shall be extended for 0 days.

(21) Appl. No.: 09/270,116

(22) Filed: Mar. 16, 1999

(30) Foreign Application Priority Data

Mar. 16, 1998 (JP) ..... 10-087998

(51) Int. Cl.[7] ..... B21K 1/30
(52) U.S. Cl. ..... 72/354.2; 29/893.34
(58) Field of Search ..... 72/344, 354.2, 72/355.2, 355.4, 355.6, 377; 29/893.34

(56) References Cited

U.S. PATENT DOCUMENTS 1,338,462 * 4/1920 Rydbeck ..... 72/354.2

FOREIGN PATENT DOCUMENTS 3-8519 * 1/1991 (JP) ..... 72/344
3-32436 * 2/1991 (JP) ..... 29/893.34
4-197547 * 7/1992 (JP) ..... 29/893.34

* cited by examiner

*Primary Examiner*—Lowell A. Larson
(74) *Attorney, Agent, or Firm*—Arent Fox Kintner Plotkin & Kahn, PLLC

(57) ABSTRACT

Crown twist forming teeth (14) are formed on the inside circumferential surface of a finishing die (13) with the thickness of each teeth being thinner in the middle part than toward both ends in the axial direction. The finishing die (13) is fitted for axial sliding in the axial direction in the axially central part of a die holder (11) through taper surfaces **(12*a*, 13*a*) diminishing from its one end to the other. A half-finished work (35, 35') with its outside circumferential surface having rough-formed twist teeth is brought into screw engagement with the finishing die (13). A first punch (25) for pressing the half-finished work (35, 35') from one axial end toward the other, and a second punch (26) for pressing the finishing die (13) from one axial end toward the other are provided. A rotary device (30) is provided to rotate the die holder (11) in the direction opposite the direction in which the half-finished work (35, 35') is rotated with the finishing die (13) when the first and second punches (25, 26)** are working under pressure.

This makes it possible to form with a forging device a helical gear having crown-formed twist teeth, with each tooth being thicker in its middle part in its axial direction than on its both ends.

7 Claims, 7 Drawing Sheets

FORGING DEVICE FOR CROWN-SHAPED HELICAL GEAR

BACKGROUND OF THE INVENTION

This invention relates to a forging device for forming a helical gear having crown-shaped teeth with the tooth thicker in the axial direction center of the twisted tooth than at both axial direction ends.

A prior art is disclosed in JP-B-6-98449. That is, a helical gear forging device in which a die having twist forming teeth is fitted for vertical sliding in the axially central part of a die holder through downward diminishing taper surfaces, a cylindrical material is placed on the die, and the device comprises a first and a second punches for pressing the material and the die from above, a counter punch in engagement with the lower end part of the die to restrict the downward movement of the material, and a rotary device for rotating the die holder in the direction opposite the direction in which the material is rotated with the die.

The above-described device of the prior art is the one in which the material is forced into the die, and twist teeth are formed on the outside circumferential surface of the material. Therefore, the thickness of the formed twist tooth is nearly constant over its entire length.

SUMMARY OF THE INVENTION

It is therefore, an object of the invention is to provide a novel forging device for forming a helical gear having crown-shaped teeth with the tooth thicker in the axial direction center of the twist tooth than at both axial direction ends.

This invention is constituted as describe below to accomplish the above-mentioned object. That is, the invention is constituted that, for forging a crown-shaped gear, crown twist forming teeth are formed on the inside circumferential surface of a finishing die with the thickness of each tooth being thinner in the middle part than toward both axial direction ends, the finishing die is fitted for axial sliding in the axial direction in the axially central part of a die holder through taper surfaces diminishing from its one end to the other, a half-finished work with its outside circumferential surface having rough-formed twist teeth is brought into screw engagement with the finishing die, and a first punch for pressing the half-finished work from one axial end toward the other, a second punch for pressing the finishing die from one axial end toward the other, and a rotary device for rotating the die holder in the direction opposite the direction in which the half-finished work is rotated with the finishing die when the first and second punches are working to press.

The invention is further constituted as above wherein the taper angle of the taper surface of the die holder is made slightly smaller than that of the taper surface of the finishing die.

The invention is still further constituted that the taper angle of the taper surface of the die holder is made slightly smaller on the small diameter side with respect to an apex in the approximate center in its axial direction than the taper angle of the taper surface of the finishing die, and is made slightly larger on the larger diameter side than the taper angle of the taper surface of the finishing die.

The invention is yet further constituted that the second punch presses the finishing die in the axial direction from one end to the other when the half-finished work is located in the middle part in the axial direction of the finishing die.

The invention is in addition constituted that the rotary device is provided with the die holder and a punch holder for axially moving together with the first and second punches, with one of them being formed with lead grooves tilted to the direction of twist of the crown twist forming tooth, and with the other of them being provided with guide pins or rollers for fitting into the lead grooves.

The invention is also constituted that a core is fitted to be immovable in the axial direction in the axially central part of the finishing die, a cylindrical half-finished work having rough-formed twist teeth on its outside circumferential surface and an axial hole in its axially central part is provided, the half-finished work is fitted between the finishing die and the core, and the first and second punches are provided to press the half-finished work and the finishing die axially from one end to the other.

The invention is additionally further constituted that a solid cylindrical half-finished work with its outside circumferential surface having rough-formed twist teeth is brought into screw engagement with the finishing die, a first and the second punches are provided to press a half-finished work and the finishing die axially from one end to the other, a counter punch in engagement with the other end part of the finishing die and for restricting the axial movement of the half-finished work is provided, and a rotary device is provided to rotate the die holder in the direction opposite the direction in which the half-finished work is rotated with the finishing die when the first and second punches are working to press.

BRIEF DESCRIPTION OF THE DRAWINGS

Other objects, features and advantages of the present invention will become apparent from the detailed description of the invention which follows, when considered in light of the accompanying drawings, in which.

DETAILED DESCRIPTION OF THE PREFERRED EMBODIMENT OF THE INVENTION

Figure 1:
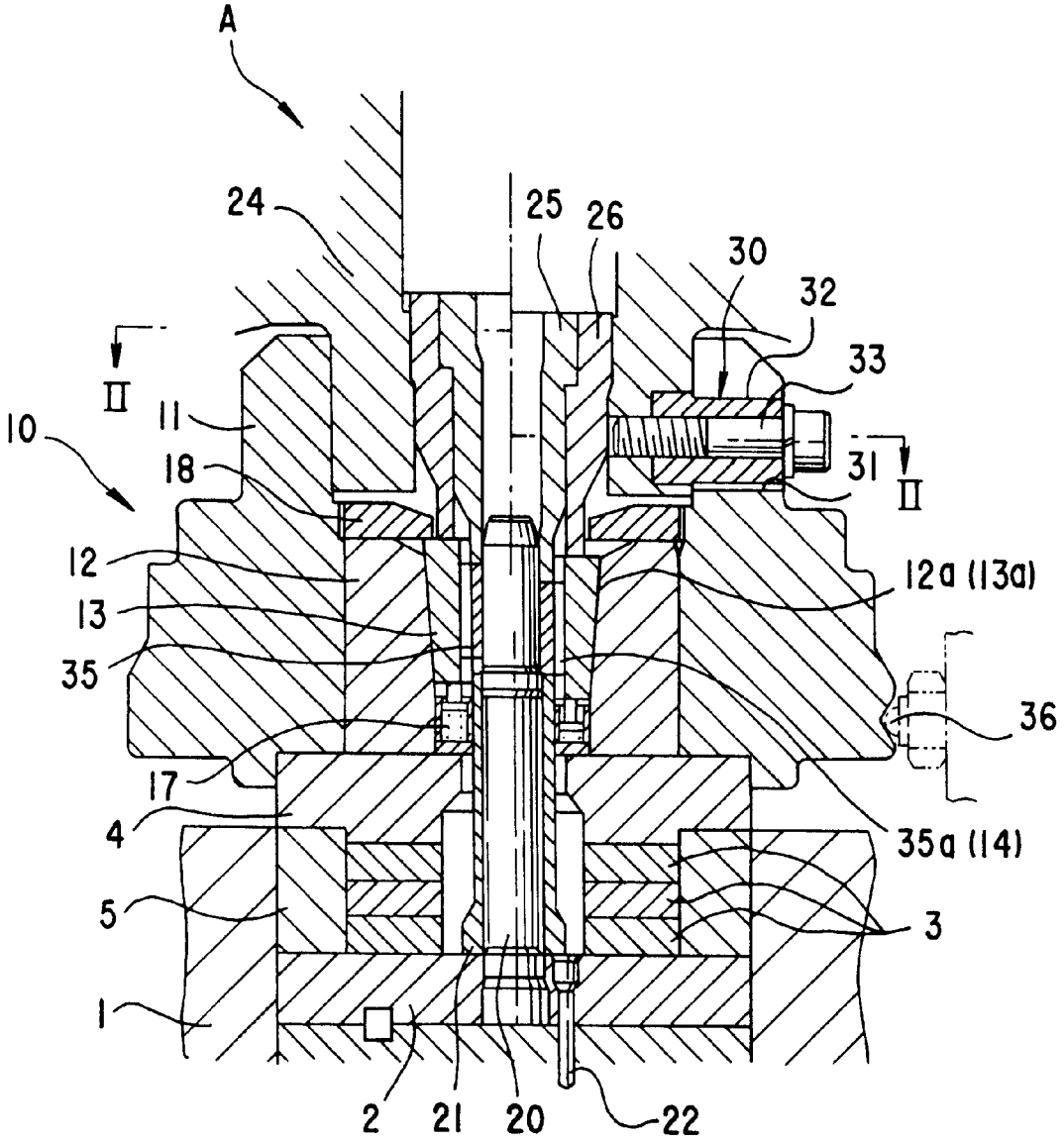
FIG. 1 is a cross-sectional view of the finish forming forging device as the first embodiment of the invention.

In FIG. 1 the symbol A denotes the finish form-forging device of the first embodiment, with the symbol 1 denoting a holding ring secured to a support table of the forging device. In the holding ring 1 are stacked in succession, a bottom disk 2, three disk-shaped flat bearings 3, and a receiving disk 4. Also in the holding ring 1 is fitted a guide ring 5 with its inside circumference holding the flat bearing 3 and the receiving disk 4 coaxial. A die unit 10 is placed on the top surface of the receiving disk 4. The die unit 10 comprises a large-diameter die holder 11 in the center of which is press-fitted a tightening ring 12 in the axial center of which is taper-fitted a finishing die 13.

Figure 4A:
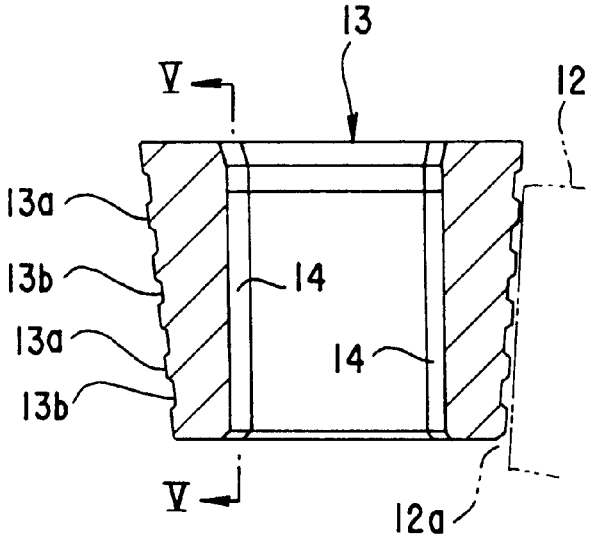
FIG. 4A and FIG. 4B are cross-sectional views for explaining the finishing die of the invention.
Figure 4B:
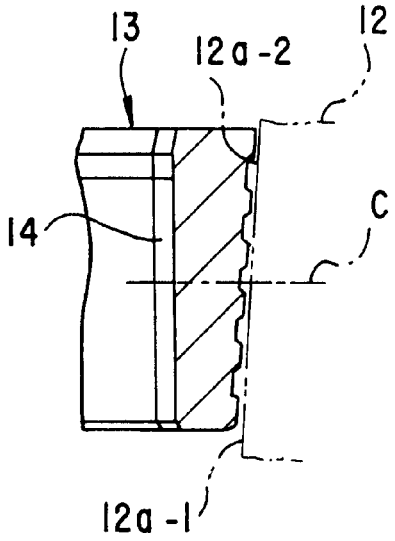

That is, the axially central part of the tightening 12 is formed with a downward diminishing taper surface (taper hole) 12*a*, while the outside circumferential surface of the finishing die 13 is formed with a downward diminishing taper surface 13*a*, so that the finishing die 13 is vertically slidably fitted into the tightening 12 by means of the taper surfaces 12*a* and 13*a*. Here, the taper angle of the taper surface 12*a* of the tightening 12 is made slightly smaller, by a range of less than 1.0 degree for example, than the taper surface (outside circumferential surface) 13*a* of the finishing die 13 so that the upper part of the taper surface 13*a* of the finishing die 13 comes into stronger contact with the taper surface 12*a* of the tightening ring 12 than its lower part as shown in FIG. 4(*a*). In this way, when a half-finished work 35 is formed, the half-finished work 35 may be finished with a high precision over its entire length as the deformation amount in the lower part of the finishing die 13 is compensated. Furthermore as shown in FIG. 4(*a*), annular oil grooves 13*b* are formed at specified over-under intervals over the taper surface 13*a* of the finishing die 13 to supply lubrication oil to that surface and permit smooth vertical sliding of the finishing die 13 within the tightening ring 12.

Here, as shown in FIG. 4(*b*), the taper angle of the taper surface 12*a* may also be made as follows: When the central part (C) with respect to generally axial (vertical) direction of the taper surface is assumed to be an apex, the taper angle of the taper surface 12*a*-1 on the smaller diameter (lower) side is made smaller by a range of less than 1.0 degree than the taper angle of the taper surface 13*a* of the finishing die 13. In this way, when a half-finished work 35 extending over the entire length of the finishing die 13 is formed, the half-finished work 35 may be finished with a high precision over its entire length as the deformation amount in the middle part of the finishing die 13 is compensated. Incidentally, the above-mentioned central part (C) with respect to vertical direction of the taper surface may vary in vertical directions depending on the shape, thickness, etc. of the half-finished work 35. Also, an apex part of the taper surface 12*a* of the tightening ring 12 corresponding to the vertical direction center (C) may have some expansion (for example 5 mm or less) in the vertical direction.

A return spring 17 as a compression coil spring is disposed under the tightening ring 12 so that the finishing die 13 is pushed up after its forming action by the reactional force of the return spring 17, that a gap is produced between the taper surface 13*a* of the finishing die 13 and the taper surface 12*a* of the tightening 12, and that lubrication oil is supplied to the oil grooves 13*b*. A restraint ring 18 for restraining the upward overshoot of the finishing die 13.

Figure 5:
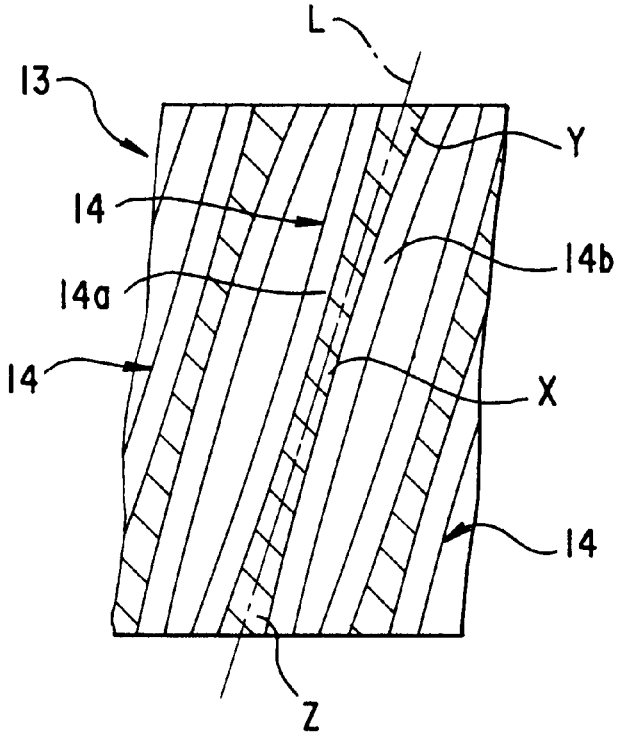
FIG. 5 shows a partial, unfolded cross section V—V of the finishing die of the invention.

The inside circumferential surface of the finishing die 13 integrally has crown twisted forming teeth 14. The crown twisted forming teeth 14 as shown in FIG. 5 is formed so that its tooth thickness (thickness in the direction crossing at right angles to the longitudinal center line L of the crown twisted forming tooth) becomes gradually thicker from the vertical (axial) direction center part X toward upper and lower ends (axial direction ends) Y and Z. In this example, the tooth thickness in the vertical direction center (X) is smaller by about 1/100 mm to 2/100 mm than that in upper and lower end parts (Y and Z). The twist angle of the crown twist tooth from a vertical direction center is about 18 degrees to the left. The crown twisted forming tooth 14 may be alternatively formed so that its thickness (thickness in the direction crossing at right angles to the longitudinal center line L of the tooth) is approximately constant and thin in the vertical (axial) direction central part and gradually thicker from both ends of the vertical direction central part toward both ends in the vertical (axial) direction ends of the tooth.

A core 20 is secured upright in the bottom disk 2 with its upper end part fitted into the axially central part of the finishing die 13. A knock-out 21 also serving as a counter punch is fitted over the outside circumference of the core 20. The knock-out 21 with its upper end fitted to the lower end part of the finishing die 13 restricts the half-finished work 35 from moving downward beyond a specified position and, after finish-forming the work (helical gear), is moved upward with an ejector pin 22 to remove the finished work upward from the finishing die 13.

A punch holder 24 moved up and down with a ram (not shown) is disposed above the die unit 10. A first punch 25 and a second punch 26 of a cylindrical shape projecting downward are secured in the axially central part of the punch holder 24. The first punch 25 is made to project downward by a specified amount from the punch 26 and to be able to, when lowered, fit into the gap between the finishing die 13 and the core 20, to strike against the upper end of the half-finished work 35 in screw engagement with the finishing die 13, and to move the half-finished work 35 downward so that the work 35 is positioned in the vertically central part of the finishing die 13.

The second punch 26, when the first punch 25 is at its bottom dead point, strikes against the top surface of the finishing die 13 to move it downward along the taper surface 12*a*, to reduce the diameter of the finishing die 13 by elastic deformation, and to radially compress the half-finished work 35.

Figure 2:
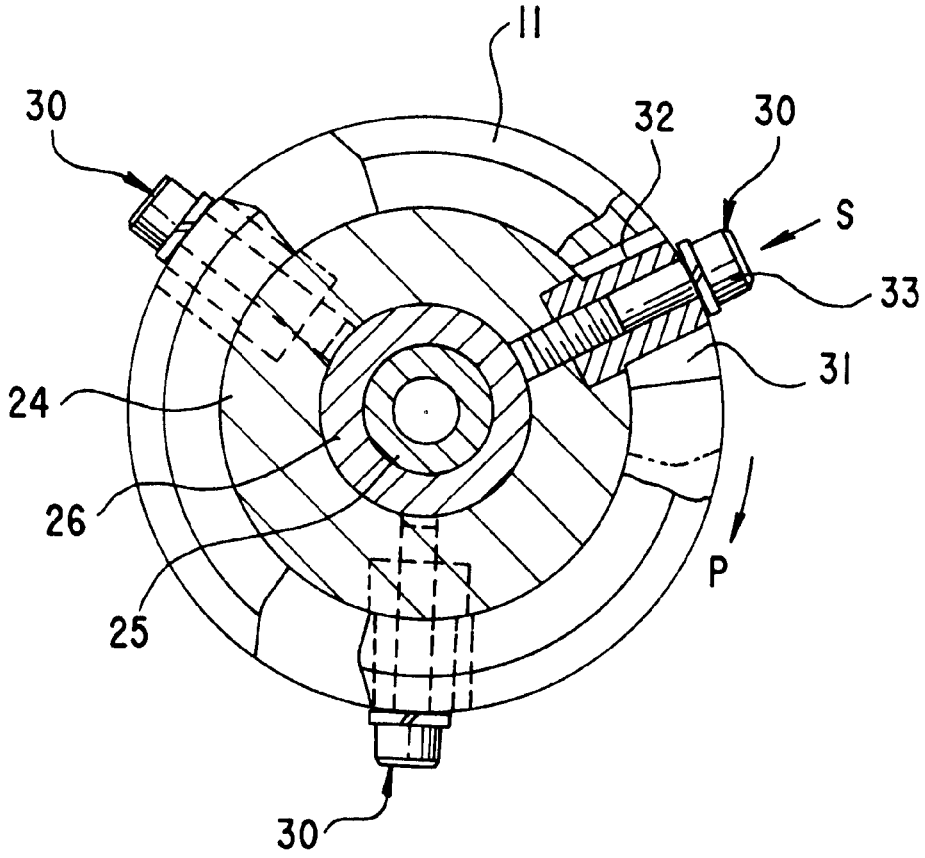
FIG. 2 shows the section II—II of FIG. 1.
Figure 3:
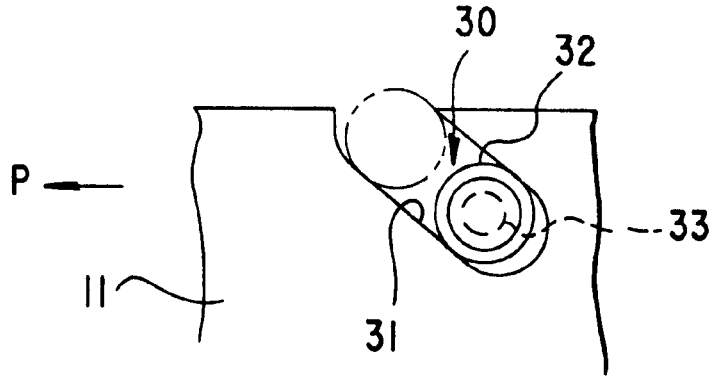
FIG. 3 is a side view of an essential part of FIG. 2 as seen in the arrow 5 direction.

A rotary device 30 is provided to rotate the die holder 11 in the direction opposite the direction in which the half-finished work 35 is rotated with the finishing die 13 when the first and second punches are in operation under pressure. The rotary device 30 is constituted as shown in FIGS. 1 through 3. That is, the upper part of the die holder 11 is fitted over the lower outside circumference of the punch holder 24. Lead grooves 31 are formed at three circumferential positions in the upper part of the die holder 11, with each groove tilting to the same direction as the crown twist forming tooth 14 and having approximately the same pitch as that of the crown twist forming tooth 14. Those lead grooves 31 are open on their upper ends as shown in FIG. 3.

On the other hand, guide rollers 32 for fitting into the lead grooves 31 are disposed rotatably at three positions on the lower outside circumference of the punch holder 24 by means of bolts 33 so as to project radially outward. Incidentally, the guide rollers 32 may be guide pins that are not rotatable. The guide rollers 32 respectively fit into the lead grooves 31, at the time the first and second punches 25 and 26 move downward and strike against the top surfaces of the half-finished work 35 and the finishing die 13, and roll along the lead grooves 31, and rotate the die holder 11 in the direction opposite the direction in which the half-finished work 35 is rotated with the finishing die 13 (in the arrow P direction in FIG. 3). By the way, the symbol 36 in FIG. 1 denotes a positioning ball for determining the initial position in the rotating direction of the die holder 11.

Figure 6:
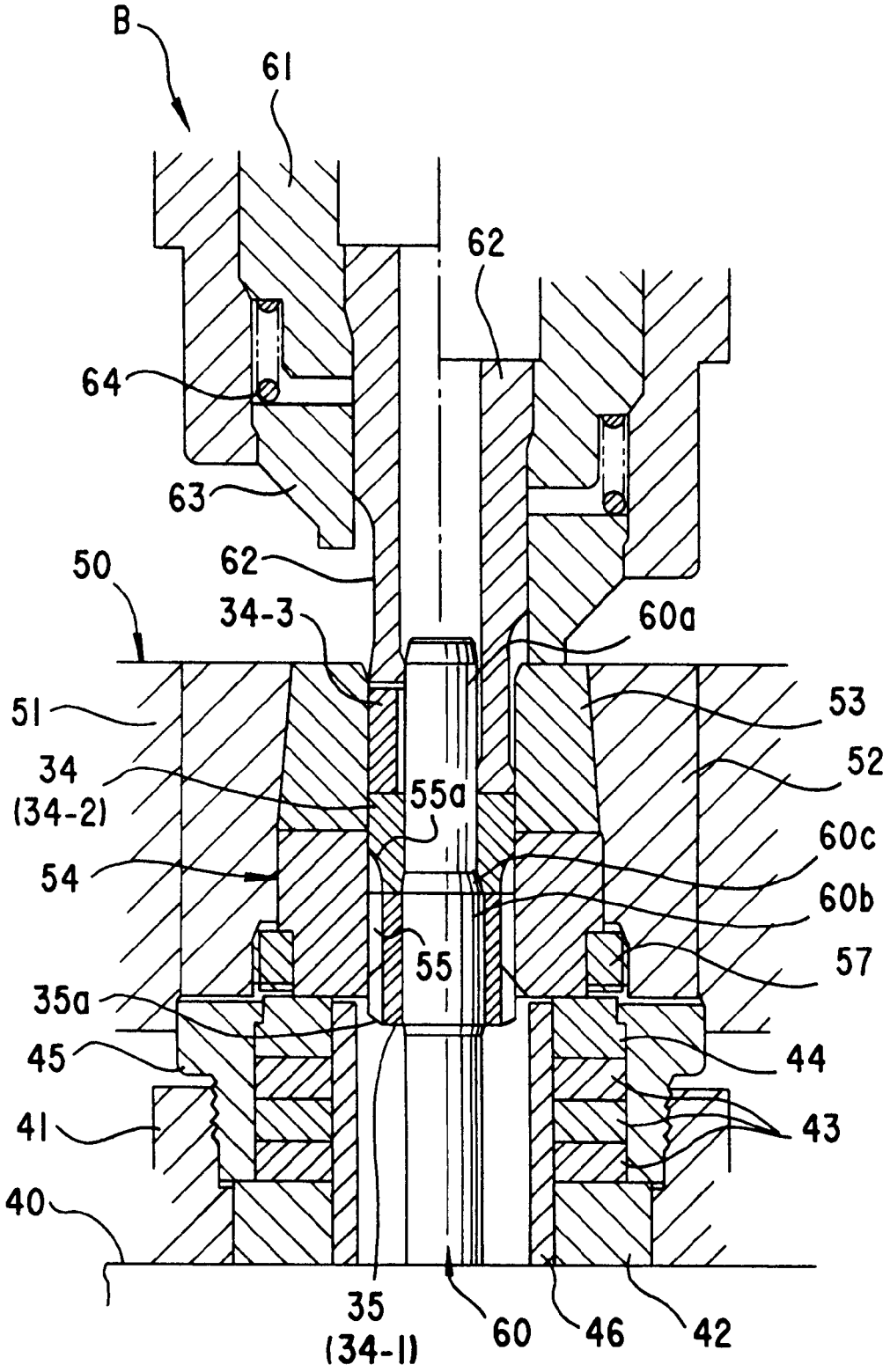
FIG. 6 is a cross-sectional view of the rough forming forging device of the invention.

Here, the half-finished work 35 is formed with a rough form-forging device B shown in FIG. 6. As seen in FIG. 6, a base ring 41 is secured on a support table 40. In the base ring 41 are stacked in succession a bottom ring 42, three flat bearings 43, and a receiving ring 44. The bottom ring 42 is secured by press fitting into the inside circumference of the base ring 41. A holding ring 45 is brought into screw engagement with the inside circumference of the upper part of the base ring 41 to rotatably hold the flat bearing 43 and the receiving ring 44. An inner guide cylinder 46 guides the flat bearings 43 and the receiving ring 44, and its lower end part is fitted into and secured with the bottom ring 42.

A die unit 50 is placed on the top surface of the receiving ring 44. The die unit 50 comprises a large diameter die holder 51 in the central part of which is press-fitted a tightening ring 52 into which are fitted a guide 53 and a rough forming die 54, both in cylindrical shape, in over-under disposition. The guide 53 is press-fitted into the upper part side of the tightening ring 52 by means of a taper surface diminishing upward, and the rough forming die 54 fitted to the lower part side of the tightening ring 52 by means of a cylindrical surface of an approximately constant diameter, and secured with a ring nut 57 screwed upward.

Figure 7:
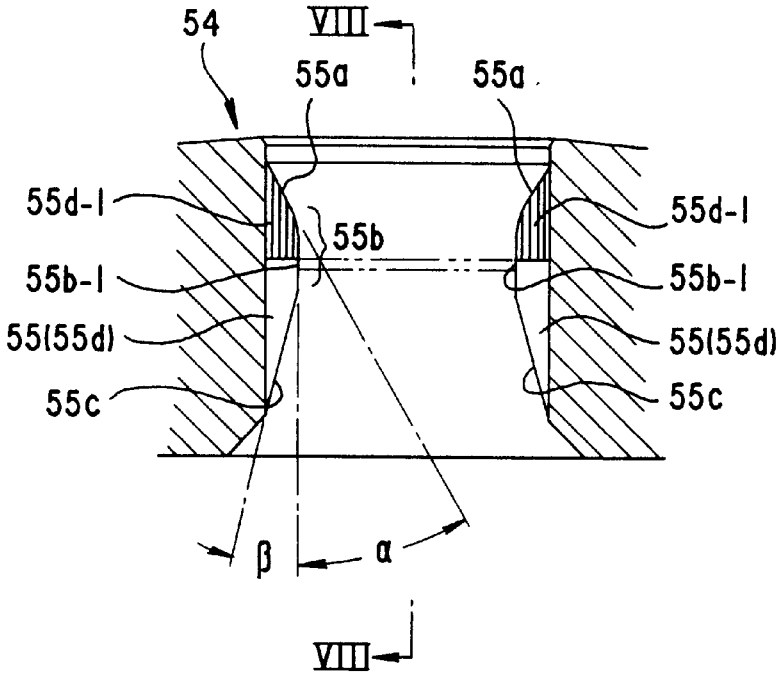
FIG. 7 is a cross-sectional view for explaining the rough forming die of the invention.
Figure 8:
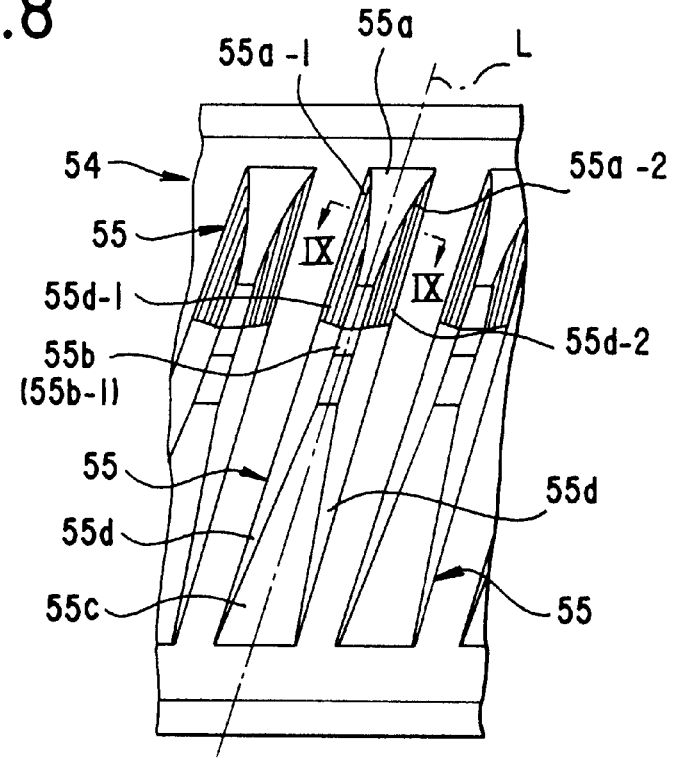
FIG. 8 shows an enlarged, partial, unfolded cross section VIII—VIII in FIG. 7 of the rough forming die.

The rough forming die 54 is for forming the half-finished work 35 and, as shown in FIGS. 7 and 8, its inside circumference has integral, twist forming teeth 55. In this example, the twist angle of the twist forming teeth 55 relative to a vertical direction line is set to about 18 degrees to the left. Each of the twist forming teeth 55 has a material introducing slope 55*a*, a forming part 55*b*, and a material discharging slope 55*c*, each being smoothly continuous from one to another, from the upper end part to be a material push-in port side to the lower part.

Figure 9:
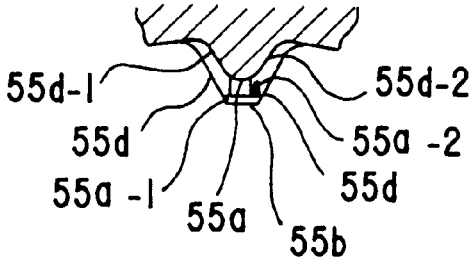
FIG. 9 shows a cross section IX—IX in FIG. 8.
Figure 10:
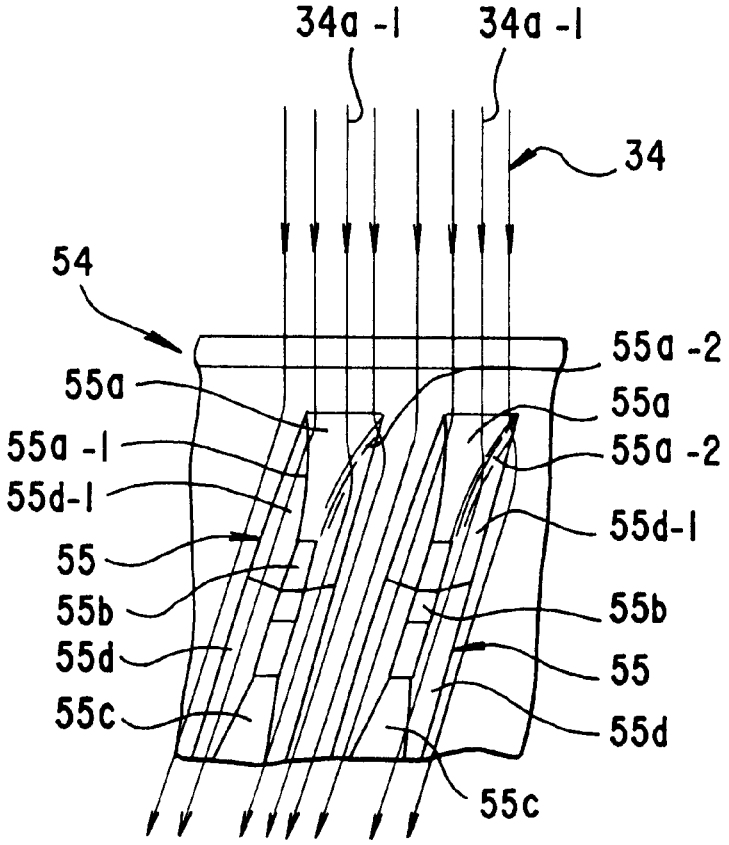
FIG. 10 is an unfolded view of an essential part of the rough forming die additionally indicating the flow of material fibers in the rough forming according to the invention.

The material introducing slope 55*a* is made so that its tooth height decreases gradually from the forming part 55*b* up (toward the material push-in port side) with a slope angle $\alpha$ of about 22.5 degrees (FIG. 7). The hatched parts in FIGS. 7 and 8 are the upper side surfaces 55*d*-1 and 55*d*-2 of the forming tooth 55, and sloped so that the tooth thickness decreases gradually from both sides of the upper end of a forming land 55*b*-1 to the upper end of the forming tooth 55 with a slope angle of about 1 to 2 degrees. As shown in FIG. 9, the right part ridge 55*a*-2 is rounded with a larger radius than the left part ridge 55*a*-1.

The forming part 55*b* is formed with, in its vertical longitudinal direction central part, the forming land 55*b*-1 which is about 1.5 mm long and of the same tooth height and cross section as those of the work, with the tooth height on the upper side of the forming land 55*b*-1 gradually decreasing to the upper side with a gentle slope angle (about 3 degrees) to be continuous to the material introducing slope 55*a*, and with the tooth height on the lower side of the forming land 55*b*-1 gradually decreasing to the lower side with a gentle slope angle (about 1.5 degrees) to be continuous to the material discharging slope 55*c*. The material discharging slope 55*c* is made with its tooth height gradually decreased to the lower (material discharging) side with a slope angle $\beta$ of about 14 degrees.

A counter punch 60 is coaxially disposed in the axial center part of the guide 53 and the rough forming die 54 and supported on the support table 40 side. The counter punch 60 is formed, in its upper part 60*a* to be fitted into the guide 53, with a smaller diameter and, in its middle part 60*b* to be fitted into the rough forming die 54 with a larger diameter. A connecting part between the parts 60*a* and 60*b* is made to be located at the material introducing slope 55*a* of the twist forming teeth 55. The lower part of the connecting part is formed with a taper part 60*c* thickening downward.

A punch holder 61 moved up and down with a ram (not shown) is disposed above the die unit 50. A cylindrical punch 62 projecting downward is secured in the axially central part of the punch holder 61. A positioning member 63 is slidably fitted on the upper outside circumference of the punch 62, engage-stopped with the punch holder 61. A positioning member 63 is slidably fitted on the upper outside circumference of the punch 62, engage-stopped with the punch holder 61, and urged with a compression coil spring 64 so as to project downward. The punch 62 is made to be able to, when moved downward, enter the gap between the guide 53 and the die unit 50 and the upper part 60*a* of the counter punch 60. The positioning member 63 serves to confirm the bottom dead point of the punch 62 when the punch 62 moves downward by a specified amount and comes into contact with the top surface of the guide 53.

The punch 62 pushes a short sized, cylindrical material 34 (34-1, 34-2, 34-3) in intermittent succession into the gap between the guide 53 and the counter punch 60. In this case, the bottom dead point of the punch 62 is set as described below. That is, the punch 62 is deemed to be in the bottom dead point when the lower part (trailing part) material 34-1 (half-finished work 35) passes over the material introducing slope 55*a* and at the same time the lower end (leading end) of the middle part (forward part) material 34-2 comes to the lower part (trailing part) of the material introducing slope 55*a* of the rough forming die 54. The middle part material 34-2 is temporarily stopped there.

In this way, the half-finished work 35 (material 34-1) is preliminarily formed (into the state of the material 34-2 in FIG. 6) with the material introducing slope 55*a* of the twist forming teeth 55, and the side surface 55*d*-1, 55*d*-2 of the material introducing slope 55*a*, and then passes the forming part 55*b* of the twist forming teeth 55 (in the state of the material 34-1 in FIG. 6) at a single stroke of the punch push-in motion of the next stage. As a result, no joint pattern due to interruption in the material flow is produced in the twist teeth part formed.

As shown in FIGS. 8 and 9, while each twist forming tooth 55 formed on the rough forming die 54 has the right and left ridges 55*a*-2 and 55*a*-1 formed with the material introducing slope 55*a* and the side surfaces 55*d* (both side surfaces on the upper side), the right ridge 55*a*-2 is rounded with a larger radius of curvature than the left ridge 55*a*-1. Therefore, when a material 34 is forced in and a fiber flow 34*a* is produced, the fiber flow 34*a*-1 arriving at the central part of the material introducing slope 55*a* goes from the right ridge 55*a*-2 side to the left side surface (behind surface) 55*d* side between the twist forming teeth 55. As a result, more amount of material 34 is supplied to the behind side surface, and a high surface pressure is produced on that side, so that the half-finished work 35 has rough-formed twisted teeth containing less voids on the behind side surfaces.

When the material 34*a*-2 passes over the material introducing slope 55*a* of the twist forming tooth 55, the material is compressed with the material introducing slope 55*a* area and the taper area 60*c* of the counter punch 60 in the radially inward direction. As a result, the material is smoothly supplied to the recess between the twist forming tooth 55, so that the rough-formed tooth 35*a* of the half-finished work 35 is filled with the material to the tip of the tooth.

The half-finished work 35 formed with the rough finish forging device B is finish-formed with the finish forging device A to obtain a helical gear having crown-shaped twist teeth. That is, with half-finished work 35 is brought into screw engagement with the upper part of the finishing die 13, the first and second punches 25 and 26 are lowered by means of the punch holder 24. In this way, first, the first punch 25 strikes against the top surface of the half-finished work 35 to force the half-finished work 35 into the finishing die 13.

When the half-finished work 35 is forced into the central part, in the vertical direction, of the finishing die 13, the second punch strikes the top surface of the finishing die 13, so that the finishing die 13 is lowered along the taper surface 12*a* of the tightening ring 12, and that the diameter of the finishing die 13 is elastically reduced to compress the half-finished work 35 in the radial direction. Along with that process, each of the guide rollers 32 provided on the punch holder 24 fits in each of the lead grooves 31 of the die holder 11 to rotate the die holder 11 in the direction opposite the direction in which the half-finished work 35 is rotated with the finishing die 13 (in the arrow P direction in FIG. 3).

Through a series of actions described above, the half-finished work 35 undergoes plastic deformation in both axial and radial directions while producing frictional forces on the contact surfaces of the crown twist forming teeth 14 of the finishing die 13 and the core 20. Also, the both of the side surfaces of the twist teeth 35*a* of the half-finished work 35 undergoes plastic deformation while being almost uniformly pressed with both of the side surfaces 14*a* and 14*b* (FIG. 5) of the crown twist forming teeth 14. That is, since the half-finished work 35 is subjected to plastic deformation in the axial and radial directions while producing frictional forces on both of the contact surfaces, pressure is made uniform. As a result, the twist tooth 35*a* of the half-finished work 35 is made into a high precision crown-shaped twist tooth, with the tooth thickness gradually increasing from both of the axial and to the middle in the axial direction.

The pressure acting on the half-finished work 35 during the above-described forming process tends to be higher on the upper side (the first punch 25 side) and lower toward the lower side and the outside diameter of the formed work tends to be smaller on the lower side than the upper side. In this case, however, since compensation is made so that the elastic deformation in the axial direction of the finishing die 13 becomes smaller toward the lower part by making the taper angle of the taper surface 12*a* of the tightening ring 12 is slightly smaller than that of the taper surface 13*a* of the finishing die 13, the diameter of the finishing die 13 is kept almost uniform from its upper to lower parts without being affected with the difference between pressures acting on the upper and lower parts of the half-finished work 35. Therefore, the tooth height of the crown-shaped twist tooth formed on the outside circumference of the half-finished work 35 (diameter of the helical gear) is approximately uniform over the entire length or from top to bottom of the tooth.

When the first and second punch 25 and 26 retracts upward after forming as described above, the diameter of the finishing die 13 is restored to the original as the finishing die 13 moves up within the tightening ring 12 due to reactional forces of itself and the return spring 17. In this way, the formed work or the helical gear having crown-shaped twist teeth may be easily removed upward from the finishing die 13.

Figure 11:
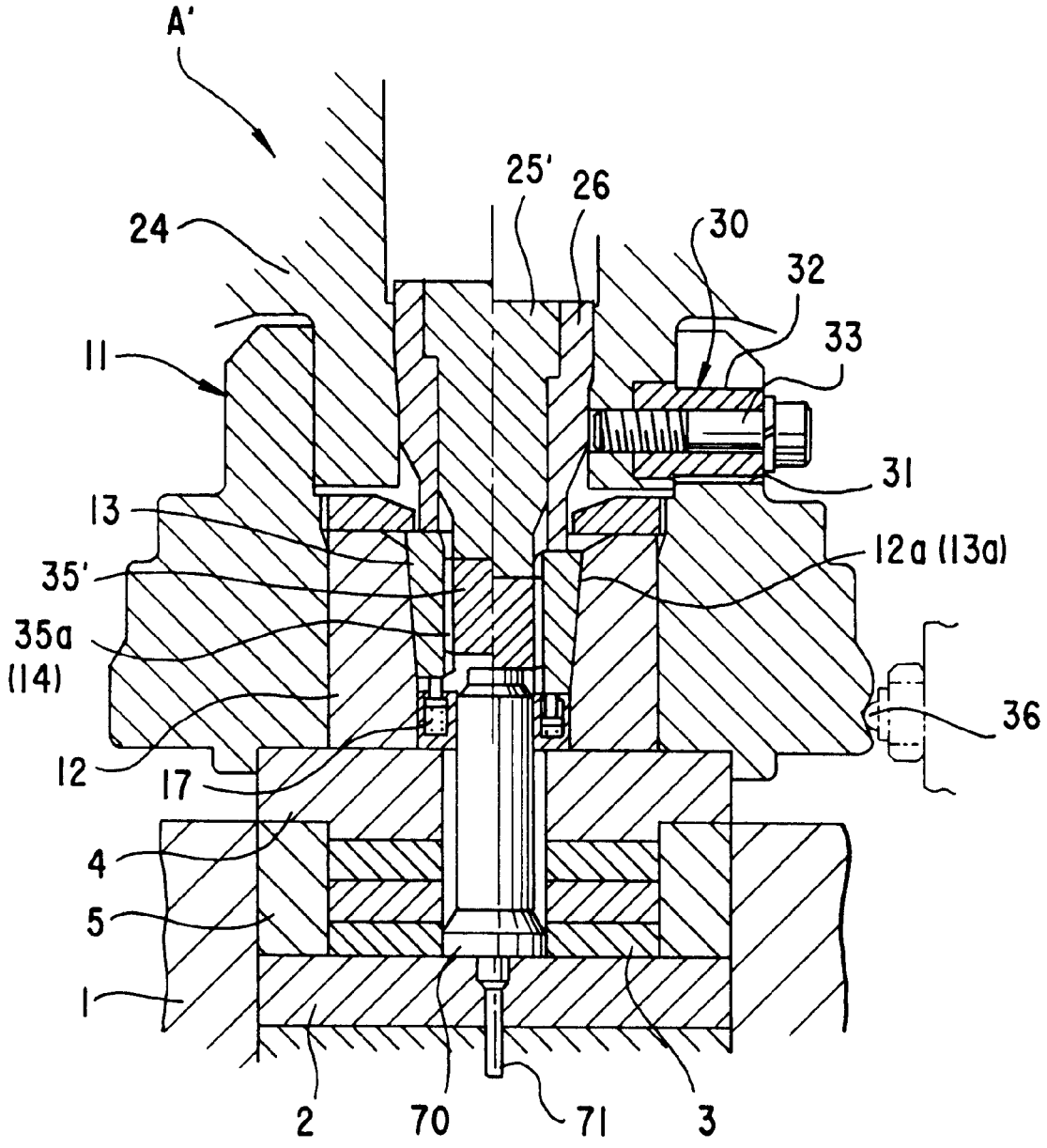
FIG. 11 is a cross-sectional view of the rough forming forging device as the second embodiment of the invention.

FIG. 11 shows another finish-forming forging device as a second embodiment of the invention. That is, a finish-forming forging device A' is for forming the outside circumferential surface part of a solid material into a half-finished work 35' having roughly formed twist teeth 35*a*. The first punch 25' of this device for depressing the half-finished work 35' is formed in a cylindrical form. The counter punch 70 is erected upright to be capable of vertical movement on the bottom disk 2. The upper end part of the counter punch 70 is fitted into the lower end part of the finishing die 13 to restrict the downward movement of the half-finished work 35' at a specified position. An ejector pin 71 is disposed in the lower axial center part of the counter punch 70 so as to move the counter punch 70 upward and remove the formed work (helical gear) upward from the finishing die 13. Since other constitution of this embodiment is the same as that of the finish forming forging device A of the first embodiment, the same parts are provided with the same symbols as those in the first embodiment and the explanation thereof is omitted.

In the case the half-finished work 35' is formed with the finish-forming forging device A', the half-finished work 35' is brought into screw engagement with the upper part of the finishing die 13, and the first and second punches 25' and 26 are lowered. In that way, first, the first punch 25' forces the half-finished work 35' into the finishing die 13. At the point where the half-finished work 35' is forced into the middle part in the vertical direction of the finishing die 13, the second punch 26 lowers the finishing die 13 along the taper surface 12*a* of the tightening ring 12 to elastically deform and reduce the diameter of the finishing die 13.

Along with the above-described action, the die holder 11 is rotated in the direction opposite the direction in which the half-finished work 35' is rotated with the finishing die 13. In the final process, the lower end of the half-finished work 35' comes into contact with the top surface of the top surface of the counter punch 70. With these series of actions, the half-finished work 35' produces frictional forces on its surface in contact with the crown twist forming teeth 14 of the finished die 13, and is subjected to plastic deformation in axial and radial directions while the pressing forces on it is being equalized. As a result, high precision crown-shaped twist teeth like those in the first embodiment are formed. After the forming, the counter punch 70 is raised with the ejector pin 71 to remove the formed work (helical gear) upward from the finishing die 13.

Incidentally, this invention may also be embodied so that the work (the helical gear having the crown-formed twist teeth) formed with the finish forming forging device A (FIG. 1) of the first embodiment and the finish forming forging device A' (FIG. 11) is turned upside down and re-formed with the finish forming forging devices A and A'. In that case, the taper angle of the taper surface 12*a* of the die holder 11 is preferably about the same as that of the taper surface 13*a* of the finishing die 13. In such a way, a higher quality work is obtained. This invention also makes it possible to form a half-finished work having a flange on its one axial direction end and roughly formed twist teeth on its outside circumferential surface. In that case, the flange side should be on the upside when it is brought into screw engagement with the finishing die 13.

As is clear from the above explanation, with the present invention since the half-finished work is compression-formed in axial and radial direction while frictional forces are produced on its surface in contact with the finishing die, the pressing forces produced with the crown twist forming teeth of the finishing die are equalized. As a result, the helical gear having the crown twist teeth with their tooth width thicker in the middle part in the axial direction of the tooth than on its both ends is formed easily.

With the invention, since compensation is made so that the taper angle of the taper surface of the tightening ring is slightly smaller than the taper angle of the taper surface of the finishing die and that the amount of elastic deformation of the finishing die in the axial direction becomes smaller toward its lower end, the outside diameter of the finishing die is kept almost uniform from its upper to lower parts without being affected with the difference between pressures acting on the upper and lower parts of the half-finished work. Therefore, the helical gear is formed with the tooth height of the crown-shaped twist tooth being approximately uniform over its the entire length. Therefore, the helical gear having an about uniform diameter over its entire length is formed.

With the invention, the amount of the elastic deformation of the middle part, in the axial direction, of the finishing die is adjusted by making the taper angle of the taper surface on the smaller diameter side of the tightening ring slightly smaller than the taper angle of the taper surface of the finishing die. As a result, a long-sized helical gear having the crown twist teeth are formed with a high precision.

With the invention, since the finishing die is elastically deformed in the shrinking direction when the half-finished work is located in the middle part in the axial direction of the die, the rough formed twist teeth of the half-finished work is smoothly formed into the crown-shaped twist teeth.

With the invention, since it is possible to adapt both of the side surfaces of the twist tooth of the half-finished work to the shape of both of the side surfaces of the crown twist forming tooth, the crown twist teeth are formed with a high precision.

With the invention, it is possible to form a cylindrical helical gear with its outside circumferential surface having crown-shaped twist teeth with a high precision.

With the invention, it is possible to form a round column-shaped helical gear with its outside circumferential surface having crown-shaped twist teeth with a high precision.

This invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A forging device for forming a crown-shaped helical gear, comprising:

a die holder having an axially central part bore diminishing in diameter from one end thereof to the other end thereof defining a tapered surface, a finishing die fitted for axial sliding in the axial direction in the axially central part of the die holder, the finishing die having a corresponding tapered surface engaging the tapered surface of the central part bore, twist forming teeth formed on the inside circumferential surface of the finishing die for forming a crown-shaped helical gear with the thickness of each tooth being thinner in a middle part than toward both ends in an axial direction of the die, wherein a half-finished work having an outside circumferential surface with rough-formed twist teeth is brought into screw engagement with the twist forming teeth of the finishing die, a first punch for axially pressing the half-finished work, a second punch for axially pressing the finishing die, and a rotary device rotating the die holder in a direction opposite a direction in which the half-finished work is rotated with the finishing die when the first and second punches respectively press the half-finished work to form the crown-shaped helical gear.

2. A forging device for forming a crown-shaped helical gear comprising:

a die holder having an axially central part bore diminishing in diameter from one end thereof to the other end thereof defining a tapered surface, a finishing die fitted for axial sliding in the axial direction in the axially central part of the die holder, the finishing die having a corresponding tapered surface engaging the tapered surface of the central part bore, twist forming teeth formed on the inside circumferential surface of the finishing die for forming a crown-shaped helical gear with the thickness of each tooth being thinner in a middle part than toward both ends in an axial direction of the die, wherein a half-finished work having an outside circumferential surface with rough-formed twist teeth is brought into screw engagement with the twist forming teeth of the finishing die, a first punch for axially pressing the half-finished work, a second punch for axially pressing the finishing die, and a rotary device rotating the die holder in a direction opposite a direction in which the half-finished work is rotated with the finishing die when the first and second punches respectively press the half-finished work to form the crown-shaped helical gear, wherein a taper angle of the tapered surface of the die holder is slightly smaller than a taper angle of the corresponding tapered surface of the finishing die.

3. A forging device for forming a crown-shaped helical gear comprising:

a die holder having an axially central part bore diminishing in diameter from one end thereof to the other end thereof defining a tapered surface, a finishing die fitted for axial sliding in the axial direction in the axially central part of the die holder, the finishing die having a corresponding tapered surface engaging the tapered surface of the central part bore, twist forming teeth formed on the inside circumferential surface of the finishing die for forming a crown-shaped helical gear with the thickness of each tooth being thinner in a middle part than toward both ends in an axial direction of the die, wherein a half-finished work having an outside circumferential surface with rough-formed twist teeth is brought into screw engagement with the twist forming teeth of the finishing die, a first punch for axially pressing the half-finished work, a second punch for axially pressing the finishing die, and a rotary device rotating the die holder in a direction opposite a direction in which the half-finished work is rotated with the finishing die when the first and second punches respectively press the half-finished work to form the crown-shaped helical gear, wherein a taper angle of the tapered surface of the die holder is slightly smaller toward a smaller diameter end of the central part bore than a taper angle of the corresponding tapered surface of the finishing die, and the taper angle of the tapered surface of the die holder is slightly larger toward a large diameter end of the central part bore than the taper angle of the corresponding tapered surface of the finishing die.

4. A forging device for forming a crown-shaped helical gear of any one of claims 1, 2, 3, wherein the second punch presses the finishing die in the axial direction from the one end to the other then the half-finished work is located in a middle part in the axial direction of the finishing die.

5. A forging device for forming a crown-shaped helical gear of any one of claims 1, 2, 3, further comprising a punch holder carrying the first and second punches, wherein the rotary device supports the die holder and the punch holder for axial movement together with the first and second punches, one of the die holder and the punch holder being formed with lead grooves tilted to a direction of twist of the crown twist forming teeth, and with the other of the die holder and the punch holder being provided with guide members fitting into the lead grooves.

6. A forging device for forming a crown-shaped helical gear of any one of claims 1, 2, 3, further comprising a non-axially movable core fitted in an axially central portion of the finishing die, wherein when a cylindrical half-finished work having rough-formed twist teeth on an outside circumferential surface thereof and an axial hole in an axially central part is fitted between the finishing die and the core, the first and second punches press the half-finished work and the finishing die axially from one end to the other end to form the crown-shaped helical gear.

7. A forging device for forming a crown-shaped helical gear of any one of claims 1, 2, 3, wherein when a solid cylindrical half-finished work having an outside circumferential surface with rough-formed twist teeth is brought into screw engagement with the finishing die, and the first punch and the second punch press the half-finished work and the finishing die axially from one end to the other end to form the crown-shaped helical gear, a counter punch is in engagement with the other end of the finishing die for restricting axial movement of the half-finished work toward the other end, while the rotary device rotates the die holder in a direction opposite a direction in which the half-finished work is rotated with the finishing die by pressing of the first and second punches.

* * * * *